United States Patent [19]

Blum

[11] 4,215,879

[45] Aug. 5, 1980

[54] LABEL SYSTEM FOR IDENTIFYING ITEMS

[76] Inventor: Alvin S. Blum, 2350 Del Mar Pl., Fort Lauderdale, Fla. 33301

[21] Appl. No.: 3,355

[22] Filed: Jan. 15, 1979

[51] Int. Cl.[2] ..... G09F 3/04

[52] U.S. Cl. ..... 283/21; 40/2 R

[58] Field of Search ..... 283/7, 18, 21; 40/2 R; 428/40, 41, 343

[56] References Cited

U.S. PATENT DOCUMENTS

| | | | |
|---|---|---|---|
| 2,213,666 | 9/1940 | Burke | 283/21 |
| 3,226,862 | 1/1966 | Gabruk | 283/21 |
| 3,993,814 | 11/1976 | Cavender | 283/18 |
| 4,110,502 | 8/1978 | Baer | 40/2 R |

*Primary Examiner*—John McQuade

[57] ABSTRACT

A system for identifying items is provided comprising: an indicia bearing support, supporting a plurality of corresponding indicia bearing, pressure sensitive adhesive labels. Means are provided for exposing the adhesive surface of said labels while labels remain detachably connected to the support. Means are provided for affixing said labels to items to be identified while labels remain detachably connected to the support.

11 Claims, 3 Drawing Figures

Control A 17
J. Bilgor 18
M. Badgers 19
C. Martinez 20
1
2
2
12
2
8
10
4
10
6
9
7
3
5
9

16 Standard 20mg
17 Control B
18 M. Siegel
19 M. Brown
20 A. Franklin
3
12
1
4
11
6
5
7

14
13
3
4
7
5
6
20

LABEL SYSTEM FOR IDENTIFYING ITEMS

BACKGROUND OF THE INVENTION

1. Field of the Invention

This invention relates to pressure sensitive adhesive labels and means for marking a plurality of items therewith.

2. Description of the Prior Art

When a number of different items are to be processed, as for example, patient serum samples in a clinical analytical laboratory, aliquots of samples and standards are often transferred to secondary containers or test tubes for further processing. These may be small plastic cups for automatic analyzers, antibody coated plastic tubes, or ordinary glass test tubes. In order to identify the final result with a particular specimen, the secondary containers are usually marked in some fashion. A worksheet is usually prepared listing the identity of all samples. An accession number or other indicia may be marked beside each entry on the worksheet and the identity or corresponding indicia may also be marked on the respective secondary container by marking means. Marking means is often a marking pen or wax pencil which is awkward to apply legibly to a round surface and easily wiped off the polyolefin tubes sometimes used. Pressure sensitive adhesive labels are also used according to the prior art, but these are time consuming since they must be peeled off their support one at a time and individually applied to the item to be marked. Prenumbered containers may also be used, but they require sorting.

SUMMARY OF THE PRESENT INVENTION

This invention provides improved means for identifying a plurality of items, such as sample containers, with adhesive labels bearing indicia and a support bearing corresponding indicia. It is an object of the present invention to provide means for exposing the adhesive surface of the labels by a single operation while they remain detachably connected to the support. It is another object that means be provided for affixing said labels to items to be identified while said labels remain detachably connected to the support. It is a further object that means be provided to affix a plurality of labels to a plurality of items with a single, easy procedure.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENTS

Figure 1:
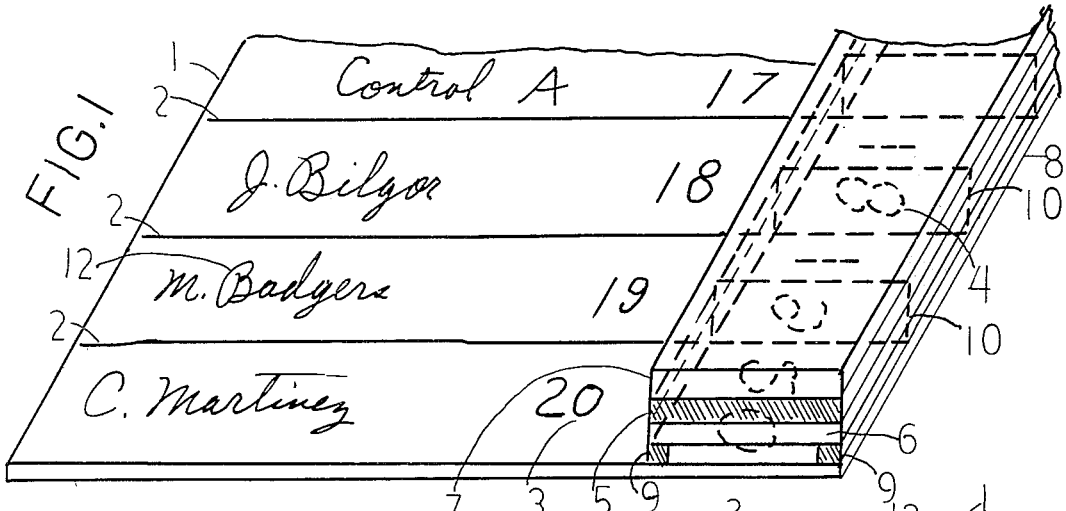
FIG. 1 is a perspective view showing composite label and support structure according to the present invention with indicia bearing surface of labels releasably adhered to the upper surface of support by adhesive releasing means.
Figure 2:
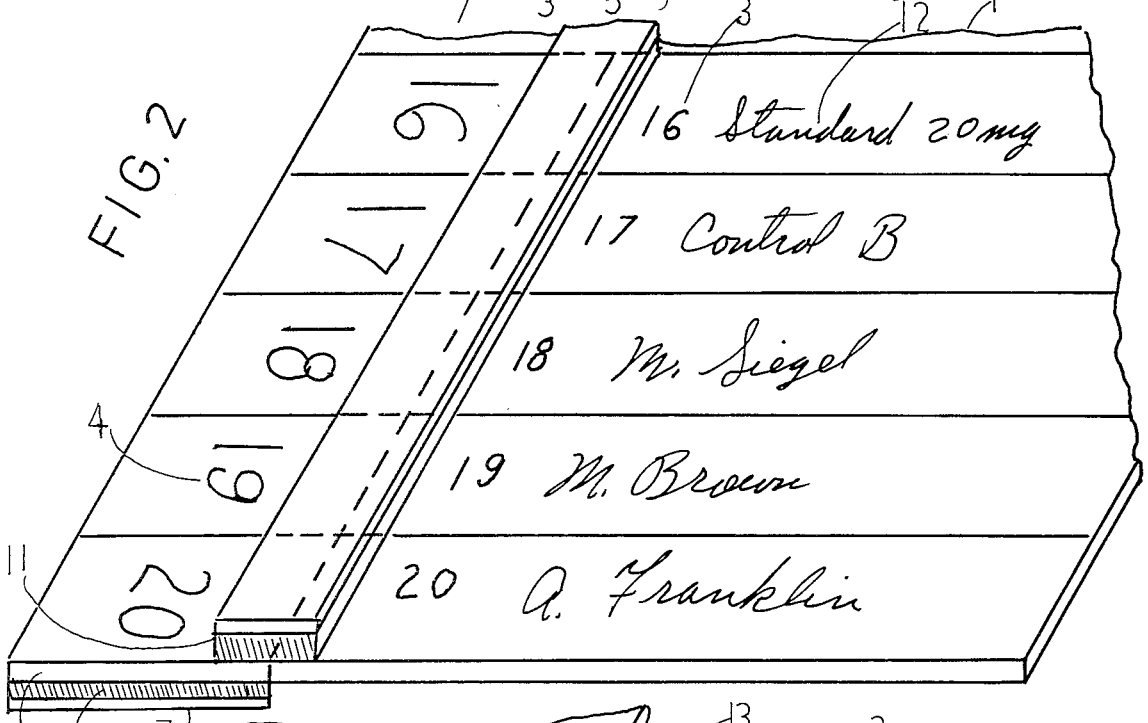
FIG. 2 is a view similar to FIG. 1 and showing another embodiment of the present invention.

With reference to FIG. 1 there is shown a support web 1 which serves also as a worksheet that is provided with ruled lines 2 for entering each item description 12, results and the like. Adjacent each entry space, a row 3 of numbers or other indicia, one for each item, is preprinted on the worksheet. Adjacent the row of numbers is another, corresponding row 4 of numbers. These are shown in phantom in FIG. 1, because they are on the underside of adhesive labels 6 fastened atop the web with adhesive surface 5 above the label. This surface is protected by single continuous release strip 7. To use the invention, the entries 12 are recorded on the worksheet. The release paper 7 is then stripped off all the labels to be used, with a single motion to expose the label adhesive. It may be stripped only down to the last entry by tearing it off against a straight edge, for example. Exposing the adhesive only to the last entry protects the balance of the labels on the support for future use. This is especially important in roll form. It also eliminates problems associated with use of a sticky worksheet having exposed adhesive of unused labels on its surface. Then test tube number one is pressed against the exposed surface of label number one and lifted. The label with the duplicate number one now adheres to the tube and is freed from the worksheet. The process is continued for each item in sequence. If the spacing of the tubes or other items in their rack corresponds to the spacing of the labels on their support, the edge 8 of worksheet 1 may be held against the upper portions of the row of tubes in their rack at the adhesive surface and a finger run along the back of the sheet to press each label against its corresponding tube. This simple process labels all the tubes in a row with a legible label in proper sequence in one easy step, whereas prior art required handling each label and/or its release paper individually. The prenumbered labels are fastened to the worksheet support web 1 by fastening and releasing means that are less tenacious than the bond created by the adhesive surface of the label sticking to the tube, but strong enough to remain in place while common release strip 7 is removed in one single operation. The releasable fastening means shown in FIG. 1 are two small parallel adhesive areas 9 on the support web. The face of the label may be treated with a release agent to enhance releasability of the label from the support. As an alternative release means, the labels may be cemented to the web in small areas with the web or label surface designed to pull off with the cement in the small areas so as not to obscure the number printed on the label. The cuts 10 shown between labels do not extend through release strip 7. One motion in pulling off common continuous release strip 7 can thereby expose the pressure sensitive adhesive surfaces of a plurality of labels while they remain releasably attached to support web 1. FIG. 2 shows an embodiment better suited where all marking is to be on one side, e.g. for use with a computer printer. A strip of labels 6, has pressure sensitive adhesive surface 5 on its underside, protected by a continuous release strip 7. The strip of labels is releasably fastened adjacent the edge of the worksheet by means of a second adhesive strip 11. After entry of identification 12 on the worksheet 1, release strip 7 is removed by a single motion. Holding adhesive surface of label edge of worksheet against appropriately labeled test tubes, the user runs his finger along the label surfaces to press each label in turn against its corresponding test tube. The adhesive strip 11 may now be pulled free.

Figure 3:
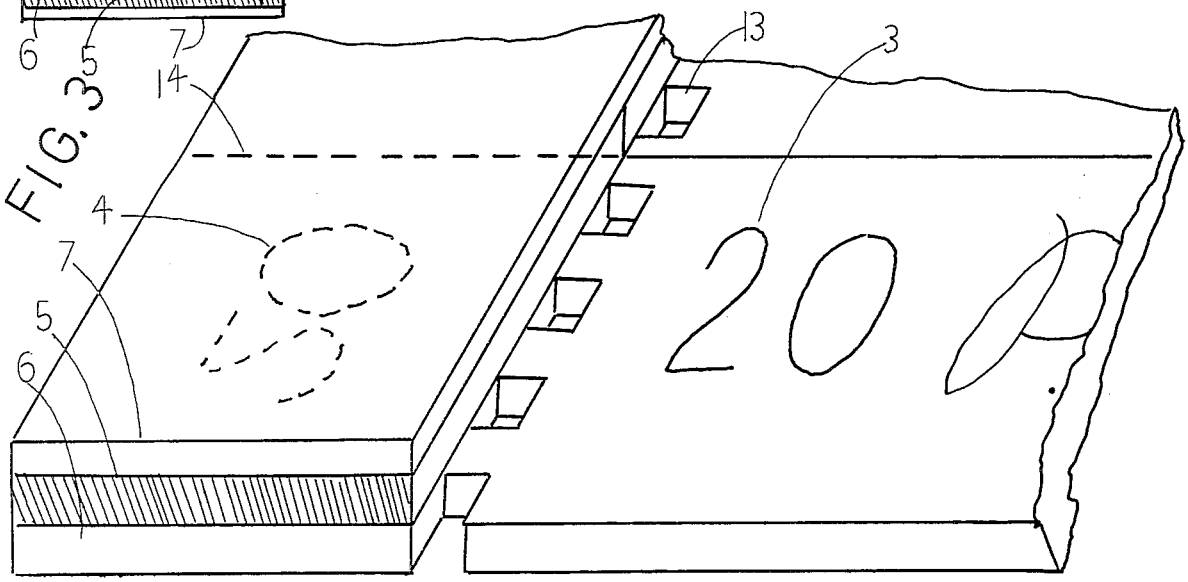
FIG. 3 is a view similar to FIG. 1 and showing another embodiment of the present invention employing perforations as releasing means.

FIG. 3 shows an embodiment of the invention wherein the labels are formed from one edge of the worksheet by a longitudinal line of perforations 13 and a series of transverse cuts 14 between individual labels. Printed numbers 4 on the underside of labels 6 correspond to entry numbers 3 on upper surface of worksheet. A layer of pressure sensitive adhesive 5 on the labels is protected by release strip 7. By removing the release strip with a single motion, a row of labels with adhesive exposed is provided ready for applicaton to items while still held in meaningful location by support means. In this embodiment, the labels are released or detached from the support after affixing to items by tearing free at the perforations 13. The perforations are release means for separating labels from support web after labels are first attached to items to be identified. The support web means may be provided with feed holes for use with machines such as computer printers.

The spacing of the labels on the support web may be arranged for the convenience of affixing to items, whereas the spacing on the information bearing portion may be arranged for another convenience such as record keeping. When the order of spaces corresponds to the order of labels on the support, no confusion need result. In another embodiment of the invention said support web means does not bear spaces for indicia and the like. These may be provided on a separate worksheet with the order retained. The label and support web or worksheet composite assembly may be provided as individual sheets or in roll form. By providing a series of colors, fewer digits are required for labels before repeating a number. Inasmuch as the present invention is subject to many variations, modifications and changes in detail, it is intended that all matter described above or shown in the accompanying drawings be interpreted as illustrative and not in a limiting sense.

What is claimed is:

1. Means for identifying a plurality of items comprising: support web means having a series of individual spaces for indicia and the like related to individual items; a plurality of adhesive labels each having a first surface coated with adhesive and a second, opposite surface for indicia corresponding or related to indicia on said support web means, said labels being releasably fastened to said support web means by releasable fastening means at other than said first adhesive coated surfaces, with the plurality of first adhesive coated surfaces being protected by common protection means and exposable by removal of said common protection means in a single operation, thereby preparing said labels for affixing to items while said labels remain releasably fastened to said support web means; and means for releasing said labels from said support web means after affixing to items.

2. The invention of claim 1, wherein common protection means comprises a continuous strip of detachable release web adhered to said plurality of first adhesive surfaces to protect said surfaces until ready for affixing to items.

3. The invention of claim 1 further comprising: indicia preprinted on said plurality of adhesive labels corresponding to indicia preprinted on said support web means, and order of said indicia bearing labels corresponding to the order of indicia on said support web means.

4. The invention of claim 1, wherein spacing of said labels on said support web means corresponds to spacing of items to be labeled in item support means.

5. The invention of claim 1, wherein said support web means is provided with feed holes.

6. The invention of claim 1, wherein said plurality of adhesive labels is formed from one edge of said support web means by a longitudinal line of partial severing or perforation and transverse cuts, said perforation line becoming said releasable fastening means.

7. The invention of claim 1, wherein said releasable fastening means comprises a detachable adhesive strip.

8. The invention of claim 1, wherein said releasable fastening means comprises releasable adhesive means between said second surface of said labels and one surface of said support web means.

9. Means for identifying a plurality of items comprising: support web means bearing a plurality of adhesive labels, each having a first surface coated with adhesive and a second, opposite surface for indicia, said labels being releasably fastened to said support web means by releasable fastening means at other than said first adhesive coated surfaces, with the plurality of first adhesive coated surfaces being protected by common protection means and exposable by removal of said common protection means in a single operation, thereby preparing said labels for affixing to items while said labels remain releasably fastened to said support web means; and means for releasing said labels from said support web means after affixing to said items.

10. The invention of claim 9, wherein common protection means comprises a continuous strip of detachable release web adhered to said plurality of first adhesive surfaces to protect said surfaces until ready for affixing to items.

11. The invention of claim 9, wherein said releasable fastening means comprises releasable adhesive means between said second surface of said labels and one surface of said support web means.

* * * * *